United States Patent [19]

Caires

[11] Patent Number: 4,774,638

[45] Date of Patent: Sep. 27, 1988

[54] PORTABLE HAND-HELD CONSUMER DEVICE

[76] Inventor: Richard T. Caires, 45 W. 60th St., New York, N.Y. 10023

[21] Appl. No.: 24,380

[22] Filed: Mar. 10, 1987

[51] Int. Cl.[4] ..... A45C 15/06

[52] U.S. Cl. ..... 362/156; 362/190; 362/200

[58] Field of Search ..... 362/156, 189, 190, 201, 362/205, 200

[56] References Cited

U.S. PATENT DOCUMENTS

| | | | |
|---|---|---|---|
| 1,363,698 | 12/1920 | Wacker | 362/200 |
| 1,397,705 | 11/1921 | Shaw et al. | 362/200 |
| 2,579,762 | 12/1951 | Schofield . | |
| 2,772,349 | 11/1956 | Chamberlin . | |
| 2,843,730 | 7/1958 | Schwartz . | |
| 2,866,083 | 12/1958 | Lima | 362/200 |
| 3,345,508 | 10/1967 | Chung | 362/200 |
| 4,091,443 | 5/1978 | Ohrenstein et al. . | |
| 4,314,317 | 2/1982 | Robson . | |
| 4,339,788 | 7/1982 | White et al. . | |
| 4,517,627 | 5/1985 | Bradford . | |
| 4,654,763 | 3/1987 | Knight . | |

FOREIGN PATENT DOCUMENTS

| | | | |
|---|---|---|---|
| 112419 | 1/1964 | Czechoslovakia | 362/200 |
| 58785 | 4/1954 | France | 362/200 |

*Primary Examiner*—Charles J. Myhre
*Assistant Examiner*—David A. Okonsky
*Attorney, Agent, or Firm*—Michael J. Striker

[57] ABSTRACT

A hand-held consumer device, having a flashlight for illuminating an inside of a container, the container having an inside wall. The flashlight is releasably mountable to the inside wall of the container by providing a first mounting surface attachable to the inside wall of the container and also a second mounting surface on the flashlight. The mounting surfaces each have interengaging members that are formed to become caught with each other when the two mounting surfaces are pressed against each other to thereby mount the flashlight to the inside wall of the container when the first mounting surface is attached to the inside wall of the container. The mounting surfaces are formed to be releasable from each other when pulled apart.

11 Claims, 4 Drawing Sheets

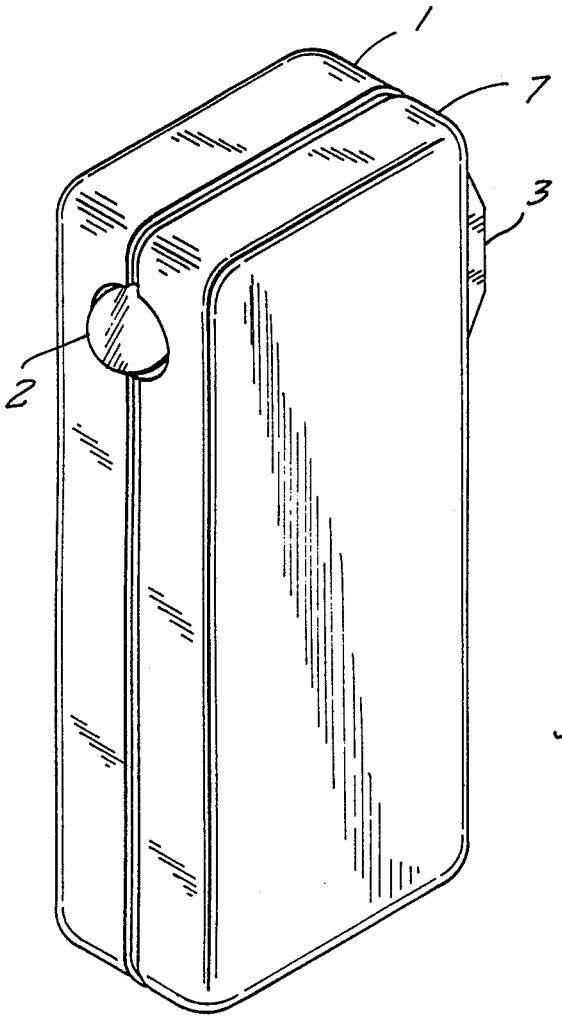
FIG. 1
FIG. 2
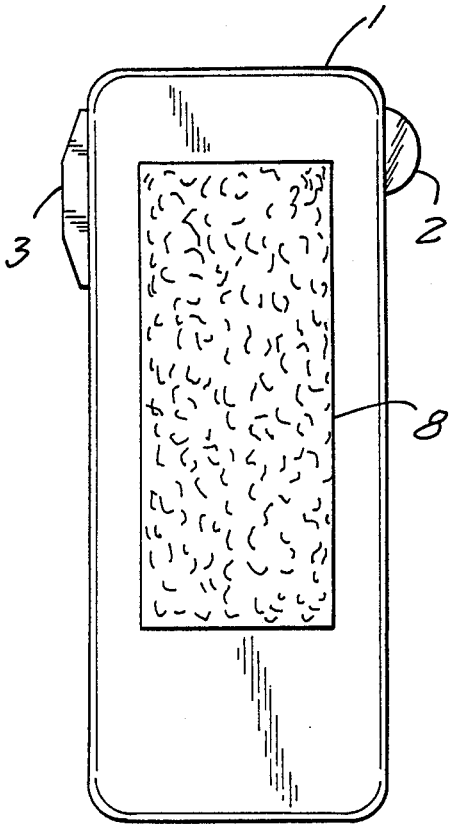

FIG. 3
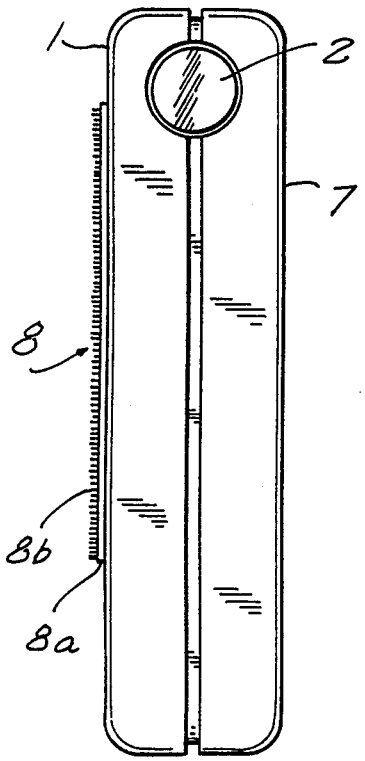
FIG. 4
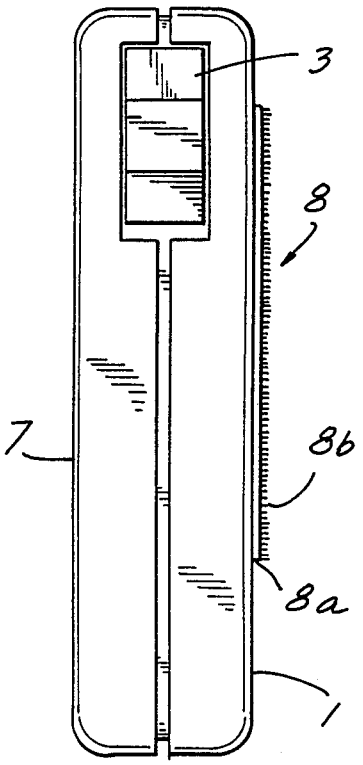
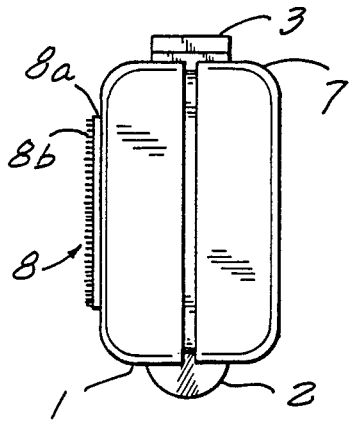
FIG. 5
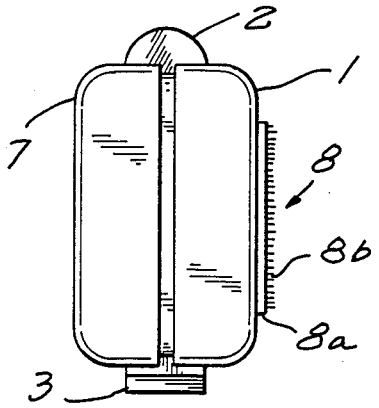
FIG. 6

FIG.9
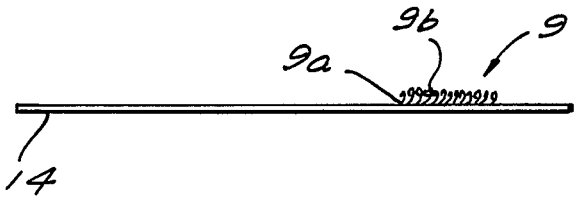
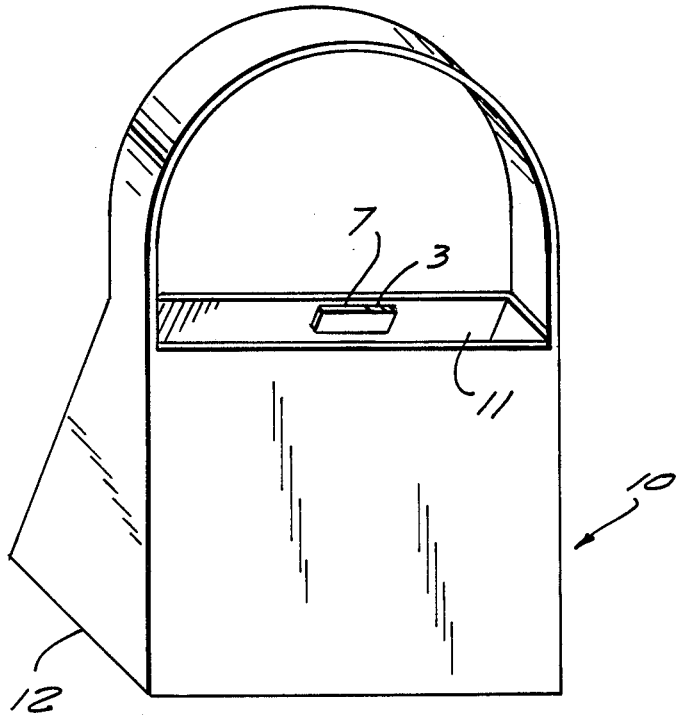
FIG.10

PORTABLE HAND-HELD CONSUMER DEVICE

BACKGROUND OF THE INVENTION

The present invention relates generally to a portable hand-held consumer device, namely a container having a hand-held flashlight detachably mounted therein.

People often have difficulty locating specific items in their handbags, purses, or similar containers. This is especially true when the inside of the container is dark and cluttered with many other items.

Portable flashlights can be used to illuminate the inside of such containers. However, if the flashlight is left loose in the container, it may take as long to find the flashlight as it would to find the particular item being sought. It also diminishes space available for storing other items.

Portable flashlights are known to have magnetic or adhesive mountings for mounting the flashlight on a surface. When a flashlight is mounted, removed for use and remounted repeatedly many times, the mounting must be durable. Magnetic mountings are better suited for repeated use than are an adhesive mountings. Adhesive mountings lose part of their sticky adhesive material to the surface being mounted. Also fuzz and other dust particles may collect on the sticky adhesive material, thereby diminishing the adhesive quality of the adhesive mounting.

SUMMARY OF THE INVENTION

It is the object of the present invention to provide a portable hand-held consumer device that is an improvement over the prior art.

In keeping with this object, and others which will become apparent hereafter, one aspect of the invention resides, briefly stated, in a hand-held consumer device, comprising means for illuminating an inside of a container that has an inside wall and means for releasably mounting said illuminating means to the inside wall of the container, said releasably mounting means including a first mounting surface attachable to the inside wall of the container and also including a second mounting surface on said illuminating means, both of said mounting surfaces having interengaging members, said interengaging members being formed so that said interengaging members of one of said mounting surfaces becomes caught by said interengaging members of the other of said mounting surfaces when said mounting surfaces are pressed against each other to thereby hold said mounting surfaces together and thereby mount said illuminating means to the inside wall of the container when said first mounting surface is attached to the inside wall of the container, said mounting surfaces being formed to be releasable from each other when pulled apart.

It is a further object to make the illuminating means readily accessible in the container, less susceptible to damage from items being tossed into the container, and located away from the lower part of the container to maximize storage of items in the lower part by mounting the illuminating means near a top opening in the upper part of the container.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a portable hand-held consumer device in the form of a flashlight in accordance with the present invention, showing the front, top and right side views in perspective.

FIG. 2 is a rear side view thereof.

FIG. 3 is a right side view thereof.

FIG. 4 is a left side view thereof.

FIG. 5 is a top view thereof.

FIG. 6 is a bottom view thereof.

FIG. 9 is a side view of a surface to be mounted with a mounting material compatible for mounting with the mounting material depicted in FIGS. 2–5.

FIG. 10 is a perspective view of a portable hand-held consumer device in the form of an illuminatable container or handbag with the inventive flashlight mounted therein in accordance with the present invention.

DETAILED DESCRIPTION OF THE PREFERRED EMBODIMENT

Figure 7:
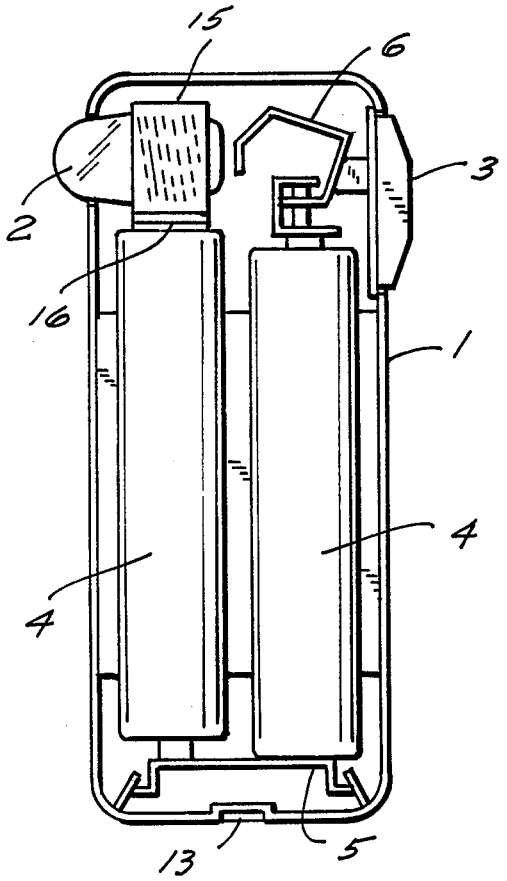
FIG. 7 is a top inside view with the cover removed.

Referring now to the drawings, FIG. 7 depicts an inside top view of a mountable portable flashlight. An electrical light circuit is plainly visible in a light circuit holder 1 and includes a light 2, a pushbutton switch 3, and batteries 4 in battery holders 5. Batteries 4 are "AAA" size. The light 2 is held in place between inner surfaces of walls 15, 16. Wall 16 is between the light 2 and the batteries 4.

Light circuit holder 1 has an open top face to make all the elements of the electrical light circuit readily accessible. Button 3 is pressed against wire spring 6 to establish electrical contact with light 2 and thereby close the light circuit and turn on the light 2. When button 3 is released, wire spring 6 biases away from light 2, thereby opening the light circuit and turning off the light 2. Light 2 projects out of holder 1 in a direction perpendicular to the direction required to turn on the light by pressing button 3. A groove 13 is formed along a portion of the outer edge of holder 1 so that a tool or fingernail can be inserted to unsnap a cover 7 from holder. The cover 7 is snapped onto holder 1, closing the entire open face of holder 1. Thus, holder 1 and cover 7 constitute a housing for the electrical light circuit.

Figure 8:
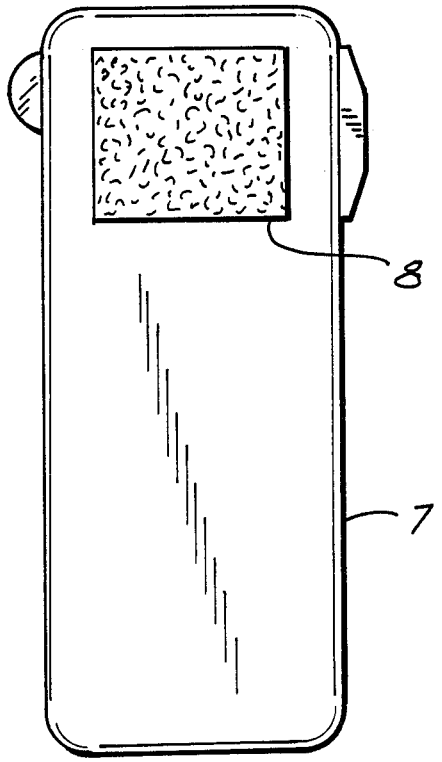
FIG. 8 is a front view of another embodiment showing the location of a mounting material on the cover.

A layer of material 8 in the form of short, synthetic hook-like projections **8*b* on a base 8*a* is arranged on the bottom surface of the holder 1 (per a first embodiment of FIGS. 2–6), or on the top surface of the holder cover 7 (per a second embodiment of FIG. 8). A layer of cloth-like material 9 having a plurality of synthetic strands or loops 9*b* on a separate base 9*a* is arranged on a surface 14 to be mounted per FIG. 9**.

The two layers of 8, 9 are releasably interengagable with each other and composed of synthetic resin, commonly known under the tradename Velcro. The two layers are fastened to their respective mounting surfaces. Their bases **8*a*, 9*b*** are shaped as a square, rectangle, or other geometric shape, representative of a patch. The area of each base is about the same.

It should also be understood that other types of shapes of interengaging layers can serve the purposes of the invention, other than a hook and loop shapes. The basic idea is that when the two surfaces are pressed against each other, the interengaging layer fastened to one surface gets caught by the interengaging layer fastened to the other surface so as to hold the surfaces together. Also, the layers should be easily separated from each other when pulling them apart and sufficiently elastic so that they do not break or become damaged during the pulling process.

Thus, when the two interengaging layers 8, 9 are pressed against each other, the strands or loops 9*b* are caught by the hook-like projections 8*b*, thereby holding the surfaces together. When pulling the layers 8, 9 apart, the hook-like projections 8*b* yield without suffering damage to permit separation to take place. In this manner, the portable flashlight is easily mounted on a surface of handbag 10 or other container by means of the two layers 8, 9.

A second embodiment would involve placing the hook-like projections 8 on a surface to be mounted 14, rather than on some surface of the flashlight. Similarly, strands 9 would be secured either to the bottom surface of the holder 1 or to the top surface of the cover 7.

In either embodiment, the hand-held consumer device may also be formed with one mounting surface secured to an illuminatable container with an upper opening, for example a handbag 10 as shown in FIG. 10. The flashlight provides a means for illuminating the inside of the handbag 10. It is preferable to mount the flashlight on the inside wall of the handbag or container 10, closer to the upper opening 11 than to the bottom 12.

There are at least four advantages that result from locating the flashlight near the upper opening 11 of the handbag or container 10. First, the flashlight is readily accessible via the upper opening 11. Second, the flashlight does not add to the clutter of items traditionally located in the lower part by the bottom 12 of the handbag or container. Third, the flashlight is less susceptible to becoming damaged from the dropping of items into the handbag or container, or from items moving around within the handbag or container while the handbag or container is being moved or carried. Fourth, by virtue of the flashlight's location at the top of the bag's interior, turning it on would illuminate the bags interior and not require to operate to hold the flashlight thus allowing freedom for both hands to hold the bag and retrieve items from it.

It will be understood that each of the elements described above, or two or more together, may also find a useful application in other types of portable hand-held consumer devices differing from the types described above.

While the invention has been illustrated and described as embodied in a portable hand-held consumer device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for the various applications without omitting features that, from the standpoint of prior art, fairly constitute essential characteristics of the generic or specific aspects of this invention.

What is claimed is new and desired to be protected by Letters Patent is set forth in the appended claims:

1. A hand-held consumer device, comprising:

a housing having a first end and a second end spaced apart from each other, said housing also defining an elongated chamber which extends in a direction of elongation between said first end and said second end;

a light bulb element having an axis and extending transverse to said direction of elongation so as to extend in an axial direction and being immediately adjacent to one part of said first end;

a first contact extending transversely to said direction of elongation over said one part of said first end;

a second contact extending transversely to said direction of elongation at said second end; and a third contact extending transversely to said direction of elongation over another part of said first end and being movable transversely to said direction of elongation and in said axial direction of said light bulb element toward and away from said light bulb element so as to respectively make and break an electrical contact with said light bulb element, said third contact being formed as a spring with a free end biasing away from said light bulb element and movable into direct contact with said light bulb element, said third contact having a single piece construction.

2. A device as defined in claim 1, wherein said first contact is formed as said first end of said elongated chamber so that no empty space forms between said longitudinal side of said light bulb element and said accomodating chamber.

3. A device as defined in claim 1, further comprising:

a button element movably held by said housing and accessible from outside said housing, said button element being movable into contact with said third contact to force said third contact into direct contact with said light bulb element and being movable out of contact with said third contact so as to permit said third contact to bias out of direct contact with and away from said light bulb element.

4. A device as defined in claim 3, wherein said housing has two opposite sides, said button element being accessible from one of said opposite sides, said light bulb element projecting through the other of said opposite sides.

5. A device as defined in claim 1, wherein said housing has a lower portion with an open face and a cover portion removably snapped onto said lower portion to close said open face so that said light circuit means is accessible from outside when said cover portion is removed.

6. A device as defined in claim 5, wherein said lower portion and said cover portion are formed to cooperate with each other so as to form a first opening and a second opening therebetween, said first opening being formed so that a portion of said light bulb element projects therethrough, said second opening being formed so that a portion of said button element projects therethrough.

7. A device as defined in claim 5, wherein said second mounting surface is attached onto said lower portion of said housing.

8. A device as defined in claim 5, wherein said second mounting surface is attached onto said cover portion of said housing.

9. A device as defined in claim 5; further comprising:

means for releasably mounting said flashlight to an inside wall of a container and including two mounting surfaces, one of said mounting surfaces being attached to said housing, each of said mounting surfaces having interengaging members, said interengaging members of said mounting surfaces being caught by each other so as to releasably hold said mounting surfaces together so that said two surfaces separate when pulled apart.

10. A device as defined in claim 9, further comprising: an illuminatable container, one of said mounting surfaces being attached to said container.

11. A device as defined in claim 10, wherein said container has an inside surface, a lower portion with a bottom, and an upper opening, said lower portion being formed to accomodate items after the items are dropped through said upper opening, said one mounting surface being arranged on said inside surface of said container closer to said upper opening than to said bottom so that said housing is readily accessible via said upper opening and so that damage to said illuminating means is minimized when the items are dropped into said lower portion of said container and so that said lower portion is free to accomodate a maximum number of the items.

* * * * *